US007726117B2

(12) United States Patent
Haft

(10) Patent No.: US 7,726,117 B2
(45) Date of Patent: Jun. 1, 2010

(54) METHOD FOR CONTROLLING AN INTERNAL COMBUSTION ENGINE

(75) Inventor: Gerhard Haft, Obermotzing (DE)

(73) Assignee: Continental Automotive GmbH, Hannover (DE)

( * ) Notice: Subject to any disclaimer, the term of this patent is extended or adjusted under 35 U.S.C. 154(b) by 316 days.

(21) Appl. No.: 11/632,020

(22) PCT Filed: Jun. 27, 2005

(86) PCT No.: PCT/EP2005/053007

§ 371 (c)(1),
(2), (4) Date: Jan. 9, 2007

(87) PCT Pub. No.: WO2006/005678

PCT Pub. Date: Jan. 19, 2006

(65) Prior Publication Data

US 2007/0186541 A1 Aug. 16, 2007

(30) Foreign Application Priority Data

Jul. 9, 2004 (DE) ..... 10 2004 033 394

(51) Int. Cl.
*F01N 3/00* (2006.01)

(52) U.S. Cl. ..... 60/285; 60/274; 60/276; 60/286; 701/7; 701/8

(58) Field of Classification Search ..... 60/274, 60/276, 277, 284, 285, 286, 300; 703/7, 703/8
See application file for complete search history.

(56) References Cited

U.S. PATENT DOCUMENTS

| | | | | |
|---|---|---|---|---|
| 5,540,747 | A | 7/1996 | Scott | |
| 5,930,993 | A * | 8/1999 | Kammann et al. | 60/274 |
| 6,295,806 | B1 * | 10/2001 | Poublon et al. | 60/274 |
| 6,321,157 | B1 * | 11/2001 | Sun et al. | 701/103 |
| 6,550,464 | B1 * | 4/2003 | Brackney | 123/676 |
| 6,691,507 | B1 * | 2/2004 | Meyer et al. | 60/285 |
| 6,898,928 | B2 * | 5/2005 | Wagner et al. | 60/285 |

FOREIGN PATENT DOCUMENTS

| | | | |
|---|---|---|---|
| DE | 19928561 | A1 | 1/2001 |
| DE | 10147619 | A1 | 7/2003 |
| DE | 102 01 465 | B4 | 8/2003 |
| EP | 0 890 724 | A2 | 1/1999 |
| JP | 6098138 | A | 4/1994 |
| JP | 6345445 | A | 12/1994 |
| WO | WO 03/029634 | A1 | 4/2003 |
| WO | WO03029634 | A1 | 4/2003 |

OTHER PUBLICATIONS

German Office Action, German application No. 102004033394.7-26, 2 pages, Nov. 9, 2004.

Japanese Office Action, Japan application No. 2007-519773, 4 pages, May 18, 2009.

* cited by examiner

*Primary Examiner*—Binh Q Tran
(74) *Attorney, Agent, or Firm*—King & Spalding L.L.P.

(57) ABSTRACT

The invention relates to a method for controlling an internal combustion engine with a motor control system that adjusts the exhaust-gas temperature by influencing the air-fuel mixture. Said motor control system has a temperature model so as to determine a preset temperature for a component in the exhaust manifold, which is achieved after a longer period of time while maintaining current operating and driving conditions. The motor control system regulates the exhaust-gas temperature depending on the preset temperature for the purpose of component protection.

14 Claims, 3 Drawing Sheets

METHOD FOR CONTROLLING AN INTERNAL COMBUSTION ENGINE

CROSS REFERENCE TO RELATED APPLICATIONS

This application is the U.S. National Stage of International Application No. PCT/EP2005/053007, filed Jun. 27, 2005 and claims the benefit thereof. The International Application claims the benefits of German Patent application No. 10 2004 033 394.7 filed Jul. 9, 2004. All of the applications are incorporated by reference herein in their entirety.

FIELD OF INVENTION

The present invention relates to method for controlling an internal combustion engine with a motor control system that adjusts the exhaust gas temperature by influencing the air-fuel mixture and which has a temperature model.

BACKGROUND OF THE INVENTION

In the case of internal combustion engines, catalytic converters are used in the exhaust gas manifold for cleaning the exhaust gases in order to comply with the emission specifications. Said motor control system has a temperature model for monitoring the temperature of the catalytic converter, which calculates the exhaust gas temperature and/or the temperature of the catalytic converter. Depending on the calculated temperature, cooling measures are initiated, in the event of the temperature being too high, to protect the catalytic converter. Such cooling measures consist of a change in the air-to-fuel ratio towards a fuel excess, namely a so-called process of making the mixture slightly richer. A regulator takes charge of said process of making the mixture slightly richer at the inlet of which the difference between the simulated and the maximum permissible temperature of the catalytic converter is provided. In the case of this basic approach, the problem is that the actual temperature of the catalytic converter only reacts to the slightly richer mixture after a considerable delay. Therefore, the regulator has a long control path. The temperature model in the motor control system takes account of this long control path and copies the delayed behavior of the catalytic converter. Depending on the selected control parameters, this brings about either an oscillation condition of the regulator or an overswing of the temperature of the catalytic converter when the regulator is activated for the first time.

WO 03029634 discloses a method in which a lambda value, depending on a modulated or a measured temperature, is adjusted at least at one critical point of the exhaust gas system, deviating from the normal operation, to a temperature-dependent lambda value, in such a way that an exhaust gas temperature is decreased if the temperature determined exceeds a predetermined temperature value.

A method for controlling a component protection function of a catalytic converter is known from DE 102 01 465 B4. For this purpose, the modulated exhaust gas temperature is taken as a function of the lambda value and of further variables. By using the inverse function it is then possible to calculate, for a maximum temperature value, a lambda desired value for the purpose of component protection. Should it be the case that the component protection function is activated during the operation of an internal combustion engine, the lambda value will then be set at the lambda desired value calculated in this way. The problem with this method is the fact that the exhaust gas temperature model can only be inverted under certain assumptions. If the temperature change in the catalytic converter is also taken into account in the temperature model because of the exothermal chemical reactions, then there is no simple relationship which allows the inverting of the function. At most there is then a bijective relationship between the temperature and the lambda value.

SUMMARY OF INVENTION

The object of the invention is to create a reliable method for controlling an internal combustion engine to provide effective protection for the components for the motor control system within without any great processing effort.

The object of the invention is achieved by a method with the features of the claims. The features of the subclaims form preferred embodiments.

The inventive method relates to controlling an internal combustion engine, as shown in FIG. 3, with a motor control system. The motor control system 19 adjusts the exhaust gas temperature by influencing the air-fuel mixture and has a temperature model 27, which preferably calculates the temperature for a component to be protected in the exhaust gas manifold 13. Such a component can for example be the catalytic converter 14 arranged in the exhaust gas manifold 13 and/or the turbine of an exhaust gas turbocharger 25. The temperature model 27 determines a preset temperature for a component arranged in the exhaust gas manifold 13. The preset temperature is the temperature that is achieved after a longer period in time while maintaining the current operating condition and the current driving condition. In this case, a preset component temperature usually requires a longer period in time until the preset temperature is achieved than is the case for a preset exhaust gas temperature. In the same way, it is for example possible that in the case of a cold start, the actual value and the preset value for the exhaust gas temperature deviate from each other. Only the preset component temperature or the preset exhaust gas temperature or both temperatures is/are referred to as the preset temperature below. Therefore, according to the invention, the temperature model 27 of the motor control system 19 also calculates as an alternative or in addition to the current temperature the temperature that will be achieved during continuous operation. The motor control system 19 regulates the exhaust gas temperature depending on the preset temperature for the purposes of component protection. However, it is still possible to use an additional variable or a plurality of variables for the control process. The problems pertaining to the long control path which occur in the prior art are avoided by using the preset temperature in an efficient manner. Even the inaccuracy occurring when the temperature model is inverted is now avoided according to the invention and also neglecting to take account of certain dependencies such as exothermal reactions for example.

In a preferred embodiment of the method according to the invention, the control is undertaken depending on the preset temperature and a maximum permissible temperature value. However, during the control process, the currently preset temperature value is determined and applied as the input variable at the regulator. An integral regulator is preferably provided as the regulator in which the controlling variable is obtained as the sum from the actual value and a weighted difference between a preset temperature and a maximum permissible temperature value.

In a preferred embodiment the focus is on a catalytic converter as the component to be protected. In this case, the preset temperature is the temperature of the catalytic converter. However, as an alternative or in addition it is possible to focus on a turbocharger or another component in the exhaust gas manifold. In the case of a turbocharger, the focus is for example on the temperature of the exhaust gas in front of the turbocharger and its value is preset.

In a preferred embodiment, the inventive temperature control is applied if the current actual value of the component temperature exceeds a predetermined threshold value. In this case the predetermined threshold value is lower than the maximum permissible temperature value.

In a preferred embodiment of the inventive method the value for the preset temperature is calculated again during the control process at predetermined intervals in time. The temperature is preferably regulated to a maximum permissible temperature value.

The inventive method is explained in detail below on the basis of the two drawings.

DETAILED DESCRIPTION OF INVENTION

Figure 1:
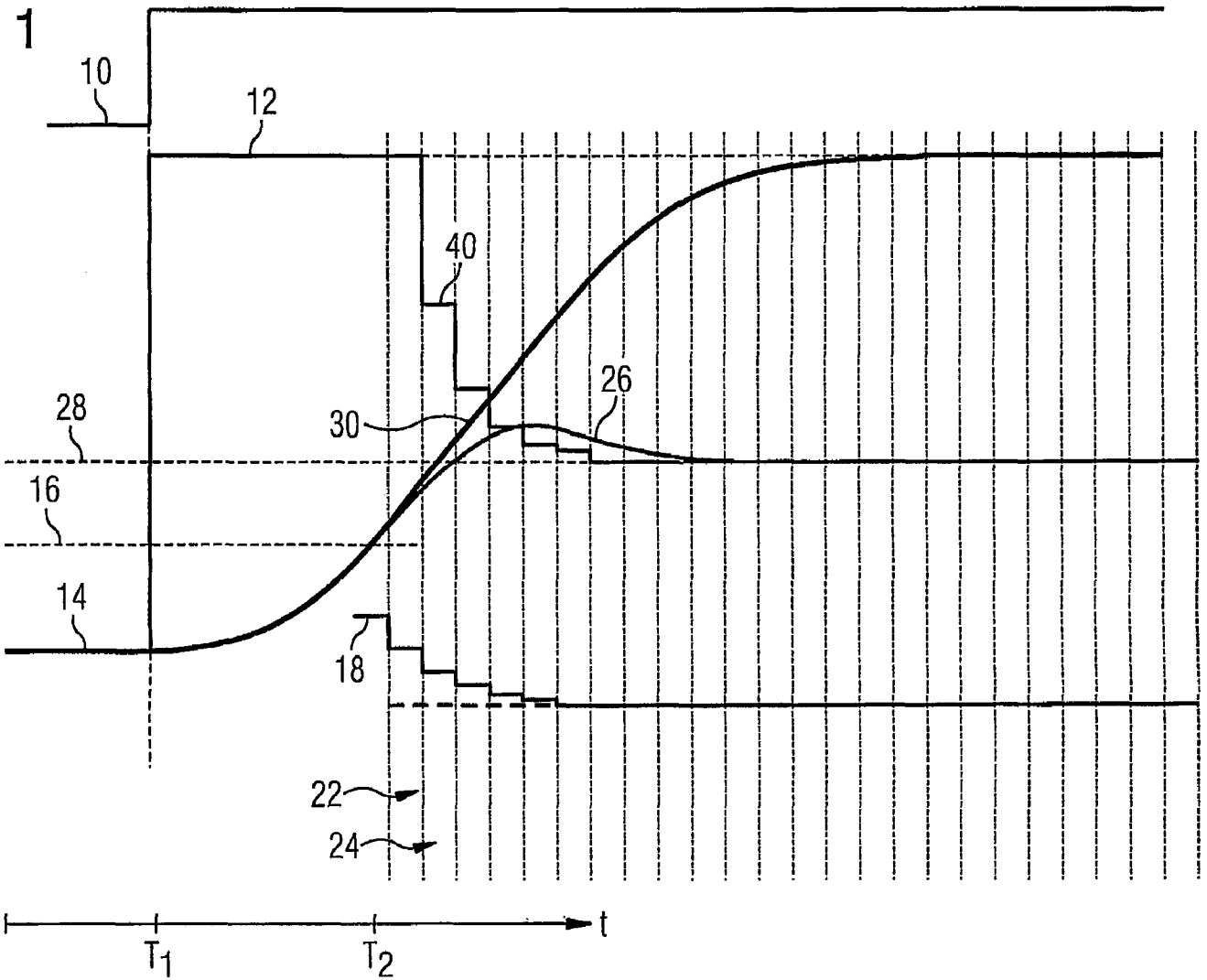
FIG. 1 the behavior of an I regulator to protect the catalytic converter by using a preset catalytic converter temperatures.

FIG. 1 shows a plurality of variables over a common time axis t, said variables being decisive for the method in accordance with the invention. At the point in time $T_1$ the mass air flow in the engine 10 increases suddenly. For the higher value of the mass air flow 10, the temperature model calculates the preset temperature 12 which will be achieved for the catalytic converter in the case of the higher mass air flow during continuous operation. The current temperature of the catalytic converter 14 subsequently rises to the load transient in $T_1$ and during the period in time $T_2$ reaches a switch-on threshold 16 for the catalytic converter function.

Figure 2:
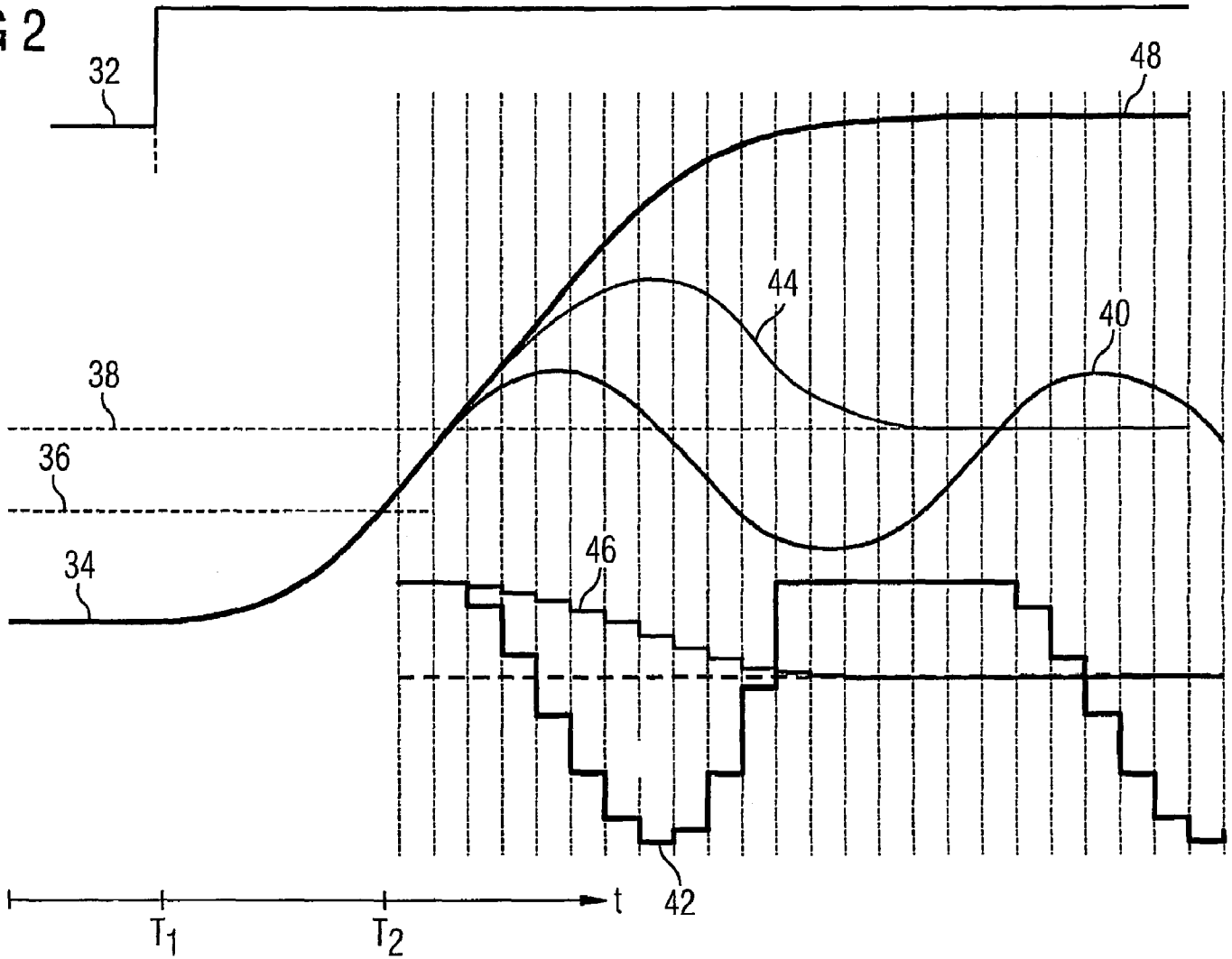
FIG. 2 the behavior of two differently adjusted I regulators to protect the catalytic converter by using the current catalytic converter temperature.

Subsequently, at $T_2$, the I regulator is used to control the exhaust gas temperature by influencing the slightly richer air-fuel mixture. The signals of the I regulator are labeled 18 in FIG. 1. Input variables for the regulator consist of the preset catalytic converter temperature 12 and a maximum permissible temperature value 28 for the catalytic converter. At a subsequent interval 22, the controlled variable 18 has already dropped because the preset temperature value 12 has approached the target variable, namely the maximum permissible temperature value 28. Likewise, the actual value 14 approaches the temperature value 28 in a similar manner. At a subsequent interval 24, the preset value 12 for the temperature of the catalytic converter has now already dropped by half at a rough estimate so that the standard controlled intervention 18 is reduced even further. FIG. 2 shows the temperature curve 26 at the catalytic converter that resulted because of the standard controlled intervention. Temperature 26 approaches the temperature value labeled 28 for the maximum permissible temperature of the catalytic converter without any strong overswing. By comparison, FIG. 1 shows the temperature curve 30 which has been produced without any control intervention. In this case. In this case the temperature 30 of the catalytic converter approaches as expected the temperature value 12 preset immediately after the sudden jump in load.

FIG. 2 shows a typical example of the shape of the temperature curve of the catalytic converter when using two different I regulators at the current temperature of the catalytic converter. At a period in time $T_1$, a load jump occurs once again and is shown by the suddenly increasing mass air flow 32. The current actual temperature 34 of the catalytic converter increases after $T_1$, and at a period in time $T_2$ intersects with the predetermined switch-on threshold 36 for the function of the catalytic converter. Subsequently an I regulator is used in the example, which carries out a process of making the said air-fuel mixture slightly richer depending on the current actual temperature 34 of the catalytic converter and a predetermined desired value 38.

The temperature curve 40 oscillating around the desired value 38 with the associated controlling variables 42 of the regulator occurs if a quickly reacting I damper is selected. In this case, oscillating regulator conditions 40 may occur in which the maximum permissible value for the temperature of the catalytic converter 38 is exceeded time and again. If a slowly reacting I regulator is used, the temperature curve labeled 44 and the associated control variable 46 occur in each case. The temperature curve 44 shows a clear overswing, which requires a longer period in time until it decays. By comparison, the non-regulated temperature curve is shown in the diagram by the number 48.

A preferred embodiment has been described above for the purpose of protecting components of a catalytic converter. In addition, other components in the exhaust gas manifold can be protected by using the preset temperature in an efficient manner. In the case of an exhaust gas turbocharger, the focus is for example on the exhaust gas temperature in front of the turbine.

Figure 3:
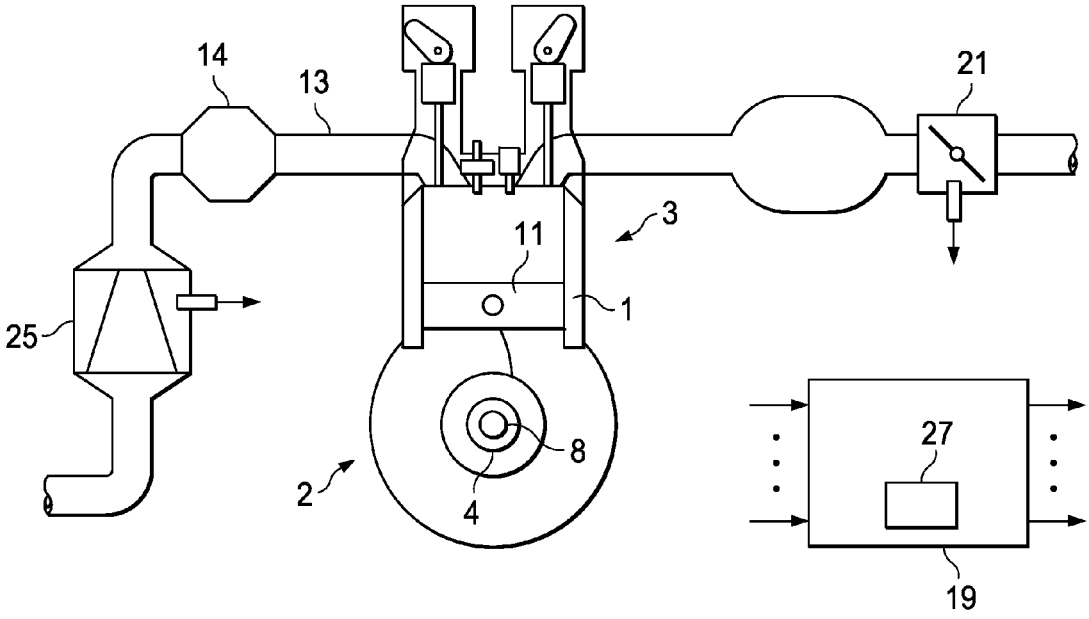
FIG. 3 an embodiment of an internal combustion engine with a motor control system.

Referring to FIG. 3, an embodiment of the invention is illustrated wherein an internal combustion engine, has the following components: an engine block 2 having a cylinder 1 and plurality of bearing supports 4 for a rotating shaft 8; a crank shaft 8 supported by the bearing supports 4; a piston 11 arranged in the cylinder 1 and connected to the crank shaft 8; a cylinder head 3 arranged on the block 2 opposite the bearing supports 4 for the shaft 8; an exhaust manifold 13 connected to the cylinder head 3; a component 14, 25 arranged in the exhaust gas manifold 13; and a control system 19 that regulates engine operation, wherein the control system 19: adjusts an air-fuel mixture of the engine according to a temperature model 27 of the control system 19 to influence an exhaust gas temperature; determines a preset temperature for a component 14, 25 in the exhaust gas manifold 13, which is achieved after a longer period in time while maintaining the current operating condition and the current driving condition; and regulates the exhaust gas temperature by influencing the air-fuel mixture as a function of the preset temperature and a maximum permissible temperature value of the component after a current temperature value of the component has exceeded a switching-on threshold value for the purpose of component 14, 25 protection.

The invention claimed is:

1. A method for controlling an internal combustion engine having a motor control system, comprising:

adjusting an air-fuel mixture of the engine according to a temperature model of the control system to influence an exhaust gas temperature;

determining a preset temperature for a component in an exhaust gas manifold of the engine, the preset temperature representing the temperature that would be achieved if the current operating condition and a current driving condition were maintained for a long time;

regulating the exhaust gas temperature by adjusting the air-fuel mixture as a function of the preset temperature and a maximum permissible temperature value of the component after a current temperature value of the component has exceeded a switching-on threshold value for the purpose of component protection; and adjusting the preset temperature based on the air-fuel mixture adjustment; and further regulating the exhaust gas temperature by adjusting the air-fuel mixture as a function of the adjusted preset temperature and the maximum permissible temperature value of the component.

2. The method as claimed in claim 1, wherein the exhaust gas temperature is regulated by an integral regulator.

3. The method as claimed in claim 2, wherein the component is a catalytic converter in the exhaust gas manifold.

4. The method as claimed in claim 2, the component is a turbocharger in the exhaust gas manifold.

5. The method as claimed in claim 2, wherein a value for a preset temperature is recalculated after a predetermined interval in time.

6. The method as claimed in claim 5, wherein the exhaust gas temperature is regulated to a maximum permissible temperature value.

7. An internal combustion engine, comprising:

an engine block having a cylinder and plurality of bearing supports for a rotating shaft;

a crank shaft supported by the bearing supports;

a piston arranged in the cylinder and connected to the crank shaft;

a cylinder head arranged on the block opposite the bearing supports for the shaft;

an exhaust manifold connected to the cylinder head;

a component arranged in the exhaust gas manifold; and a control system that regulates engine operation, wherein the control system:

adjusts an air-fuel mixture of the engine according to a temperature model of the control system to influence an exhaust gas temperature;

determines a preset temperature for a component in the exhaust gas manifold, the preset temperature representing the temperature that would be achieved if the current operating condition and a current driving condition were maintained for a long time;

regulates the exhaust gas temperature by adjusting the air-fuel mixture as a function of the preset temperature and a maximum permissible temperature value of the component after a current temperature value of the component has exceeded a switching-on threshold value for the purpose of component protection;

adjusts the preset temperature based on the air-fuel mixture adjustment; and further regulates the exhaust gas temperature by adjusting the air-fuel mixture as a function of the adjusted preset temperature and the maximum permissible temperature value of the component.

8. The engine as claimed in claim 7, wherein the exhaust gas temperature is regulated by an integral regulator.

9. The engine as claimed in claim 8, wherein the component is a catalytic converter in the exhaust gas manifold.

10. The engine as claimed in claim 8, the component is a turbocharger in the exhaust gas manifold.

11. The engine as claimed in claim 8, wherein a value for a preset temperature is recalculated after a predetermined interval in time.

12. The engine as claimed in claim 11, wherein the exhaust gas temperature is regulated to a maximum permissible temperature value.

13. The method as claimed in claim 1, comprising iteratively adjusting the preset temperature and the air-fuel mixture such that the preset temperature and the exhaust gas temperature approach the maximum permissible temperature value of the component over time.

14. The engine as claimed in claim 7, wherein the control system iteratively adjusts the preset temperature and the air-fuel mixture such that the preset temperature and the exhaust gas temperature approach the maximum permissible temperature value of the component over time.

* * * * *